United States Patent [19]

Kobayashi

[11] 4,145,951

[45] Mar. 27, 1979

[54] SUPPORTING DEVICE FOR MUSICAL INSTRUMENTS SUCH AS HIGH-HAT CYMBALS

[75] Inventor: Haruhiko Kobayashi, Hamamatsu, Japan

[73] Assignee: Nippon Gakki Seizo Kabushiki Kaisha, Japan

[21] Appl. No.: 783,395

[22] Filed: Mar. 31, 1977

[30] Foreign Application Priority Data

Apr. 5, 1976 [JP] Japan ..... 51/41794[U]

[51] Int. Cl.[2] ..... G10D 13/00

[52] U.S. Cl. ..... 84/422 R

[58] Field of Search ..... 84/422 R, 411 R, 421, 84/402

[56] References Cited

U.S. PATENT DOCUMENTS 3,167,995 2/1965 La Londe ..... 84/422 X 3,464,305 9/1969 Meazzi et al. ..... 84/422

*Primary Examiner*—John Gonzales

*Attorney, Agent, or Firm*—Ostrolenk, Faber, Gerb & Soffen

[57] ABSTRACT

In the construction of a supporting device for musical instruments such as high-hat cymbals including a pipe mechanism for supporting the stationary one of the instruments, an operating rod operationally coupled to a foot pedal and for carrying movable one of the instruments confronting the stationary one, a tension spring for urging the operating rod to move against pressure applied to the foot pedal is arranged separately from and outside the pipe mechanism so that adjustment of the spring force can be effected quite freely following player's requirement without giving no influence upon the mechanical design of the pipe mechanism while mitigating the resonance of noises generated by the spring.

20 Claims, 2 Drawing Figures

SUPPORTING DEVICE FOR MUSICAL INSTRUMENTS SUCH AS HIGH-HAT CYMBALS

BACKGROUND OF THE INVENTION

The present invention relates to an improved supporting device for musical instruments such as high-hat cymbals, and more particularly relates to improvement in the spring mechanism for urging an operating rod carrying the movable one of the musical instruments to move against pressure applied to a foot pedal.

In the construction of the conventional supporting device for musical instruments such as high-hat stands, the stationary on of the musical instruments, e.g. the lower stationary cymbal, is supported by a pipe mechanism, which is comprised of an upper and lower pipes slidably coupled to each other in a telescopic fashion, mounted on a tripoid. An operating rod extends slidably through the pipe mechanism and carries the movable one of the musical instruments, e.g. the upper movable cymbal over the staionary one of the musical instruments. This operating rod is operationally coupled to a foot pedal for the player of the musical instruments. When the foot pedal is stepped in, the operating rod is lowered through the pipe mechanism to hit the movable one of the musical instrument against the stationary one of the musical instruments, thereby generating tones. In order to make the movable one of the musical instruments automatically resume its original position, i.e. a position apart from the stationary one of the musical instruments, after the pressure on the foot pedal is removed, a compression spring is provided within the pipe mechanism in such an arrangement that the spring is compressed when the foot pedal is stepped in and the operating rod is lowered. When the pressure applied to the foot pedal is removed, repulsion of the compression spring makes the operating rod lift and the movable one of the musical instruments resume its original position.

Provision of the spring element within the pipe mechanism and use of the compression spring for this purpose are inevitably accompanied with several drawbacks.

When a spring element of a large spring constant is used, reaction of the spring element to player's action is very quick. That is, upon removal of the pressure on the foot pedal, the movable one of the musical instruments instantly resume its original position without any substantial delay. Thus, even when the foot pedal is repeatedly stepped in in succession, the reaction of the movable one of the musical instruments fairly follows the quick action of the player. However, strong repulsion of the spring element accordingly requires strong force for pressing the foot pedal and it is rather difficult for beginners to step in the foot pedal with strong force repeatedly in succession. When a spring element of a small spring constant is used, it is easy even for beginners to step in the foot pedal repeatedly in succession as relatively small force is required for pressing the foot pedal. In this case, however, it is rather difficult to expect for quick and fair reaction of the upper one of the musical instruments. For this reason, it is preferable that the repulsion of the spring element can be adjusted in accordance with the player's requirement, which varies from player to player. In the construction of the conventional supporting device used for this purpose, the spring element is fixedly or semi-fixedly encased within the pipe mechanism and adjustment of the spring repulsion is effected by turning an adjusting scew disposed to the lower end of the pipe mechanism to which one end of the spring element is connected. This adjusting system may enable fine range adjustment of the spring repulsion but is not adapted for wide range adjustment of the spring repulsion. So, when wide range adjustment of the spring repulsion is required to meet the player's preference, it is necessary to use a different set of supporting device equipped with a spring element of a different spring constant, which is very disadvantageous from economic point of view.

In addition, the conventional pipe mechanism encases therein the spring element as well as the operating rod, necessarily making the hollow space of the pipe large. Such a large hollow space of the pipe mechanism functions like a kind of resonator amplifying undesirable noises. Namely, compression and extension of the spring element inevitably cause frequent frictional contact thereof with the inner wall of the pipe mechanism and this frictional contact generates undesirable noises. These noises are amplified due to the above-described resonant nature of the pipe mechanism and the amplified noises are issued outside the pipe mechanism to disturb tones normally generated by the musical instruments.

Especially when strong spring repulsion is required, it is necessary to enlarge the dimension of the spring element and this naturally necessitates corresponding increase in the diameter of the pipe mechanism in order to minimize the above-described frictional contact of the spring element with the inner wall of the pipe mechanism. This does not fairly meet the general requirement for compactness of the supporting device. Thus, with the construction of the conventional supporting device for musical instruments adjustment of the spring repulsion inevitably necessitate corresponding change in the design of the pipe mechanism for encasing the spring element.

Further, use of the compression spring usually connects to relatively delayed reaction of the spring system to the action imposed upon the foot pedal by the player.

OBJECTS OF THE INVENTION

It is the primary object of the present invention to provide an improved supporting device for musical instruments such as high-bat cymbals which slashes undesirable noises conventionally generated by reaction of the spring element for urging the movable one of the instruments.

It is another object of the present invention to provide an improved supporting device for musical instruments such as high-bat cymbals which enables both small and wide range adjustments of the spring repulsion for urging the movable one of the instruments by simple operation to be applied to the device, thereby fairly meeting player's requirement which varies considerably from player to player.

It is the other object of the present invention to provide an improved supporting device for musical instruments such as high-bat cymbals which enables free adjustment of the spring repulsion for urging the movable one of the instruments without giving any influence upon the pipe mechanism for supporting the stationary one of the instruments.

It is a further object of the present invention to provide an improved supporting device for musical instruments such as high-hat cymbals which assures quick reaction of the movable one of the instruments fairly following the action imposed on the foot treadle by players.

BRIEF SUMMARY OF THE INVENTION

In accordance with the present invention, a foot treadle is arranged below a pipe mechanism for supporting a stationary one of said musical instruments and an operating rod, which extends axially through the pipe mechanism to hold a movable one of the musical instruments, is operationally coupled to the foot treadle. A spring is used for urging the operating rod to move against pressure applied to the foot treadle and is arranged outside the pipe mechanism. This spring is operationally coupled to the above-described operating rod.

In a preferred embodiment of the present invention, means is coupled to the spring for adjusting the repulsion of the spring.

DETAILED EXPLANATION OF THE INVENTION

Figure 1:
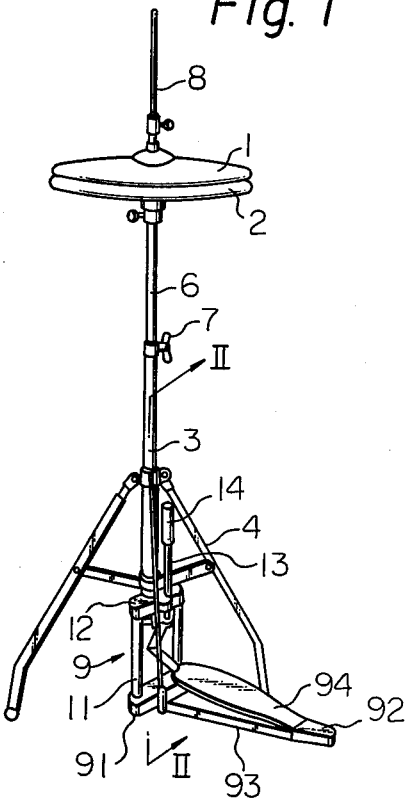
FIG. 1 is a perspective view of the entire construction of one embodiment of the supporting device in accordance with the present invention.

The entire construction of an embodiment of the present invention is shown in FIG. 1, in which a high-hat cymbal stand in accordance with the present invention is used for supporting a pair of cooperating cymbals, i.e. an upper movable cymbal 1 and a lower stationary cymbal 2. The stand comprises a lower vertical pipe 3 mounted on a tripoid 4 to be placed on the floor and an upper vertical pipe 6 inserted at the lower end portion thereof into the lower vertical pipe 3 in axial alignment to each other. The level of the upper vertical pipe 6 is adjustable with respect to the lower vertical pipe 3 and the upper vertical pipe 6 is firmly registable at the selected level via a fixing screw 7.

The stationary lower cymbal 2 is fixedly mounted atop the upper vertical pipe 6. An operating rod 8 is slidably arranged through the upper and lower vertical pipes 6 and 3 with the top end portion thereof being exposed upwardly out of the upper vertical pipe 6. The movable upper cymbal 1 is fixedly mounted atop the operating rod 8 while downwardly and coaxially confronting the lower stationary cymbal 2.

Figure 2:
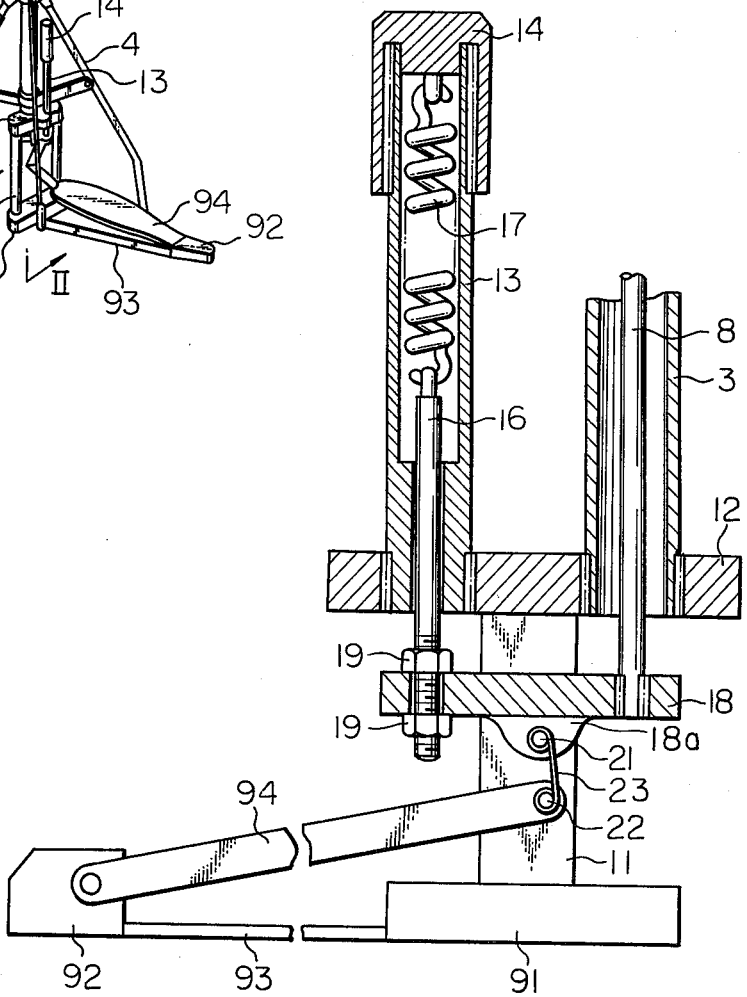
FIG. 2 is a section taken along the line II—II in FIG. 1.

The lower vertical pipe 3 is accompanied at the lower end portion thereof with a foot treadle 9 which is, as shown in FIG. 2, comprised of a base plate 91, a heel piece 92 coupled to the base plate 91 via a connecting bar 93 and a foot pedal 94 pivoted at one end thereof to the heel piece 92.

A pair of vertical stands 11 are arranged on the base plate 91 in order to support a horizontal supporting plate 12 in such an arrangement that the other end of the foot pedal 94 is positioned just below the supporting plate 12.

The lower end of the lower vertical pipe 3 is fixed to the supporting plate 12 via a screw engagement and the lower end portion of the operating rod 8 extends downwardly beyond the undersurface of the supporting plate 12.

A tubular body 13 is arranged substantially in parallel to the lower vertical pipe 3 with the lower end thereof being detachably fixed to the supporting plate 12 via a screw engagement. An adjusting cap 14 is screwed over the top end portion of the tubular body 13. A tension rod 16 is axially slidably arranged in the tubular body 13 and the lower end portion of the tension rod 16 projects downwardly through the closed lower end of the tubular body 13. A tension spring 17 is arranged within the tubular body 13 with one end, i.e. the upper end, thereof being hooked to the inner end of the adjusting cap 14 and the other end, i.e. the lower end, thereof being hooked to the top end of the tension rod 16. With this arrangement, the tension spring 17 always urges the tension rod 16 to move upwardly towards the interior of the tubular body 13.

A connecting plate 18 is arranged under the horizontal supporting plate 12 in such an arrangement that the lower end of the operating rod 8 is fixed to the connecting plate 18 via a screw engagement. Further, the threaded lower end of the tension rod 16 extends idlly through the connecting plate 18 but detachably fixed thereto via a pair of fixing nuts 19. Thus, the operating rod 8 and the tension rod 16 are operationally and fixedly coupled to each other via the connecting plate 18 but this coupling can easily be cancelled by loosening the fixing nuts 19.

A pin 21 extends laterally from the lower projection **18*a* of the connecting plate 18 and the end of foot pedal 94 positioned under the connecting plate 18 is provided with a laterally projecting pin 22. A connecting element 23 is provided between the foot pedal 94 and the connecting plate 18 with one end thereof being pivoted to the pin 22 of the foot pedal 94 and the other end thereof being pivoted to the pin 21 of the connecting plate 18. Thus, the foot pedal 94, the operating rod 8 and the tension rod 16 are operationally coupled to each other via the connecting element 23 and the connecting plate 18**.

In the inoperative disposition of the foot treadle 9, i.e. when the foot pedal 94 is left free, the spring force by th tension spring 17 lifts the tension rod 16 and, accordingly, the operating rod 8 via the connecting plate 18. The foot pedal 94 is kept swung upwardly about its pivotal point on the heel piece 92 and the upper movable cymbal 1 is kept upwardly apart from the lower stationary cymbal 2.

In the operative disposition of the foot treadle 9, i.e. when the foot pedal 94 is stepped in and swung downwardly about its pivotal point on the heel piece 92, the connecting plate 18 is pulled downwardly via the connecting element 23 while overcoming the spring force by the tension spring 17. This naturally causes lowering of the operating rod 8 and the upper movable cymbal 1 hits the lower stationary cymbal 2. As the pressure on the foot pedal 94 is removed, the spring force by the tension spring 17 urges the operating rod 8 to move upwardly via the tension rod 16 and the connecting plate 18 and the upper movable cymbal 1 parts upwardly from the lower stationary cymbal 2.

With the above-described construction of the stand in accordance with the present invention, fine range adjustment of the spring force by the tension spring 17 can be easily effected by turning the adjusting cap 14 screwed over the top end portion of the tubular body 13. By this turning of the adjusting cap 14, the effective distance between the two hooked points of the tension spring 17, i.e. the distance between the inner end of the adjusting cap 14 and the top end of the tension rod 16, can be adjusted as desired. This change in the effective distance between the two hooked points of the tension spring 17 naturally causes corresponding change in the spring force therof resisting the pressure applied to the foot pedal 94.

For wide range adjustment of the spring force, the adjusting cap 14 is removed and one tension spring in the tubular body 13 can be replaced by another tension spring of a different spring coefficient. For this purpose, it is also employable that the assembly made up of the tubular body 13, the adjusting cap 14, the tension spring 17 and the tension rod 16 is replaced as a whole. In order to carry out this replacement, the coupling of the tension rod 16 with the connecting plate 18 is firstly cancelled by loosening the fixing nuts 19 and, secondly, the screw engagement of the tubular body 13 with the supporting plate 12 is cancelled. In order to set the new assembly in position, the tubular body 13 of the new assembly is firstly fixed to the supporting plate 12 and, secondly,the tension rod 16 of the new assembly is fixedly coupled to the connecting plate 18 by fastening the fixing nuts 19.

In accordance with the present invention, the spring mechanism for resuming the free disposition of the foot treadle is arranged outside the pipe mechanism for supporting the cymbals and, therefore, adjustment of the spring force for resuming the free disposition of the foot tradle and for resisting the pressure applied to the foot pedal can be carried out quite freely in accordance with actual requirement while giving substantially no influence upon the design of the pipe mechanism for supporting cymbals. Thus, even when highly increased spring force is required, increase in the spring force can be effected without inducing corresponding increase in the diameters of the pipe mechanism for supporting cymbals.

In addition, the tubular body encasing the spring can be of a tightly confined and narrow-spaced type and, therefore, no undesirable noises are issued outside or resonated even when friction arises between the encased spring and the encasing tubular body. Disturbance to normal tones to be developed by the musical instrument can be greatly minimized.

Further, although the spring 17 for urging the operating rod of the present invention is not limited to the tension spring, it is empirically said that use of the tension spring instead of the compression spring easily assures quicker reaction of the spring mechanism, i.e. quick resumption of the free disposition by the foot treadle when the pressure on the foot pedal is removed.

Further, when the parts related to the spring mechanism are replaced as an assembly, adjustment of the spring force can be very easily, simply and freely carried out in accordance with actual requirement.

I claim:

1. An improved supporting device for musical instruments comprising, in combination, a pipe mechanism for supporting a stationary one of the musical instruments;

a foot treadle arranged below said pipe mechanism;

an operating rod operationally coupled to said foot treadle and extending through said pipe mechanism to hold a movable one of said musical instruments;

a spring for urging said operating rod to move against pressure applied to said foot treadle;

mounting means for mounting said spring outside said pipe mechanism; said mounting means including a support on said supporting device and held stationary with respect to motion of said foot treadle and said operating rod relative to said supporting device; and a tubular body disposed on said support and extending substantially parallel to said pipe mechanism to encase said spring; and means attached to said foot treadle for operationally coupling said spring to said operating rod.

2. The improved supporting device as claimed in claim 1 in which said spring is of tension type.

3. The improved supporting device as claimed in claim 2 further comprising means attached to said tubular body for adjusting the spring force of said tension spring.

4. The improved supporting device as claimed in claim 1 in which said tubular body is detachably fixed to said support.

5. The improved supporting device as claimed in claim 4 in which said tubular body is fixed to said support via a screw engagement.

6. The improved supporting device as claimed in claim 1 in which said pipe mechanism is detachably fixed to said support.

7. The improved supporting device as claimed in claim 6 in which said pipe mechanism is fixed to said support via a screw engagement.

8. The improved supporting device as claimed in claim 1, further comprising a cap disposed atop said tubular body; said spring being connected at one end thereof to said cap and at the other end thereof to said means for operationally coupling said spring to said rod.

9. The improved supporting device as claimed in claim 8 in which said cap is disposed atop said tubular body via a screw engagement.

10. The improved supporting device as claimed in claim 1 in which said means for operationally coupling said spring to said rod includes a tension rod idly extending throughh said tubular body and connected to on end of said spring; and a connecting plate arranged below said support and coupled to said tension rod, said operating rod and said foot treadle.

11. The improved supporting device as claimed in claim 10 in which said connecting plate is detachably fixed to said tension rod.

12. The improved supporting device as claimed in claim 11 in which said tension rod extends idly through said connecting plate and is fixed thereto via a pair of fixing nuts.

13. The improved supporting device as claimed in claim 10 in which said connecting plate is detachably fixed to said operating rod.

14. The improved supporting device as claimed in claim 13 in which said connecting plate is fixed to said operating rod via a screw engagement.

15. The improved supporting device as claimed in claim 10 in which said connecting plate is pivotally coupled to the swingable end of said foot pedal.

16. The improved supporting device as claimed in claim 8, in which said spring is of tension type.

17. The improved supporting device as claimed in claim 10, in which said spring is of tension type.

18. The improved supporting device as claimed claim 8, wherein said cap is adjustable along said tubular body for adjusting the spring force of said spring.

19. The improved supporting device as claimed in claim 16, wherein said cap is adjustable along said tubular body for adjusting the spring force of said spring.

20. An improved supporting device for musical instruments comprising, in combination, a pipe mechanism for supporting a stationary one of the musical instruments;

a foot treadle arranged below said pipe mechanism;

a support mounted on said foot treadle and supporting said pipe mechanism;

an operating rod extending through said pipe mechanism with the lower end thereof projecting downwardly from said support;

a tubular body disposed at the lower end thereof to said support and extending substantially parallel to said pipe mechanism;

a cap disposed atop said tubular body;

a spring encased within said tubular body with one end thereof connected to said cap;

a tension rod extending through said tubular body with the top end thereof being connected to the other end of said spring and the lower end thereof projecting downwardly from said support;

a connecting plate arranged below said support and connected the projecting ends of said operating and tension rods; and a connecting element for pivotally connecting said connecting element to the swingable end of said foot treadle.

* * * * *